US008523249B2

(12) United States Patent
Hodgin et al.

(10) Patent No.: US 8,523,249 B2
(45) Date of Patent: Sep. 3, 2013

(54) REVERSIBLE LATCH BOLT

(75) Inventors: Chris Hodgin, Louisville, TN (US); J. Steven Gray, Maryville, TN (US)

(73) Assignee: Yale Security Inc., Monroe, NC (US)

( * ) Notice: Subject to any disclaimer, the term of this patent is extended or adjusted under 35 U.S.C. 154(b) by 1154 days.

(21) Appl. No.: 12/064,980

(22) PCT Filed: Aug. 31, 2005

(86) PCT No.: PCT/US2005/031013

§ 371 (c)(1),
(2), (4) Date: Feb. 27, 2008

(87) PCT Pub. No.: WO2007/027176

PCT Pub. Date: Mar. 8, 2007

(65) Prior Publication Data

US 2008/0246288 A1 Oct. 9, 2008

(51) Int. Cl.
*E05B 17/00* (2006.01)

(52) U.S. Cl.
USPC ..... 292/244; 292/169.17; 292/169.14; 292/335

(58) Field of Classification Search
USPC ..... 292/244, 169.17, 335, 169.14; 70/107, 70/106
See application file for complete search history.

(56) References Cited

U.S. PATENT DOCUMENTS

| | | | |
|---|---|---|---|
| 1,469,829 | A | 10/1823 | Teich |
| 81,931 | A | 9/1868 | Munger |
| 168,986 | A | 10/1875 | Griscom |
| 197,531 | A | 11/1877 | Vetter |
| 235,963 | A | 12/1880 | Prouty |
| 269,098 | A | 12/1882 | Niles |

(Continued)

FOREIGN PATENT DOCUMENTS

| | | |
|---|---|---|
| CA | 2458045 A1 | 8/2004 |
| DE | 1938639 | 2/1971 |

(Continued)

OTHER PUBLICATIONS

Yale Security Inc., International Patent Application No. PCT/US05/31013; Preliminary Report on Patentability, dated Mar. 13, 2008.

(Continued)

*Primary Examiner* — Carlos Lugo
*Assistant Examiner* — Mark Williams
(74) *Attorney, Agent, or Firm* — Michael G. Johnston; Moore & Van Allen PLLC

(57) ABSTRACT

A latch assembly comprises a first portion (32) defining an opening and a second portion (54) slidably disposed in the opening for movement of the first portion along the second portion. The second portion includes a stop which is larger than the opening for preventing further movement of the first portion along the second portion in a first direction. A securing element releasably connects the first portion and the second portion in a first relative axially connected position. In a mortise lock (20), the first portion and the second portion are thus movable together relative to the housing so that the first portion at least partially non-rotatably projects outwardly from the opening in the edge wall of the housing in an extended position and is inside the housing in a retracted position. Disconnecting the first portion from the second portion allows the first portion to move along the second portion in the first direction to a second axial position.

17 Claims, 14 Drawing Sheets

(56) References Cited

U.S. PATENT DOCUMENTS

| | | | |
|---|---|---|---|
| 286,580 | A | 10/1883 | Billings |
| 302,657 | A | 7/1884 | Heizmann et al. |
| 366,998 | A | 7/1887 | Crownfield |
| 950,108 | A | 2/1910 | Lawrence |
| 1,057,663 | A | 4/1913 | Page |
| 1,126,181 | A | 1/1915 | Cleaver |
| 1,168,525 | A | 1/1916 | Lurie |
| 1,456,466 | A | 5/1923 | Sauerbrei |
| 1,627,420 | A | 5/1927 | Thomas |
| 2,516,991 | A | 8/1950 | Heyer |
| 2,673,758 | A | 3/1954 | Schlage |
| 2,718,421 | A | 9/1955 | Slopa et al. |
| 2,823,538 | A | 2/1958 | Fresard |
| 3,211,486 | A | 10/1965 | Crandell |
| 3,235,301 | A | 2/1966 | Russell et al. |
| 3,242,706 | A | 3/1966 | Check |
| 3,257,136 | A | 6/1966 | Russell et al. |
| 3,361,462 | A | 1/1968 | Foster |
| 3,361,464 | A | 1/1968 | Foster |
| RE26,677 | E | 10/1969 | Russell et al. |
| 3,631,695 | A | 1/1972 | Perlick et al. |
| 3,672,714 | A | 6/1972 | Schultz |
| 3,750,433 | A | 8/1973 | Sanders |
| 3,769,822 | A | 11/1973 | Yulkowski |
| 3,808,849 | A | 5/1974 | Alexander |
| 4,071,270 | A | 1/1978 | Alexander |
| 4,118,056 | A | 10/1978 | Alexander |
| 4,243,256 | A | 1/1981 | Frydrych |
| 4,286,812 | A | 9/1981 | Sprekeler |
| 4,333,324 | A | 6/1982 | Dietrich et al. |
| 4,389,061 | A | 6/1983 | Foshee |
| 4,462,230 | A | 7/1984 | Evans |
| 4,468,059 | A | 8/1984 | Nelson et al. |
| 4,470,278 | A | 9/1984 | Hale et al. |
| 4,470,279 | A | 9/1984 | Neary et al. |
| 4,583,382 | A | 4/1986 | Hull |
| 4,674,776 | A | 6/1987 | James |
| 4,695,082 | A | 9/1987 | Marks |
| 4,696,174 | A | 9/1987 | Marks |
| 4,765,663 | A | 8/1988 | Raymond et al. |
| 4,798,065 | A | 1/1989 | DeForrest, Sr. |
| 4,817,404 | A | 4/1989 | Eisermann et al. |
| 4,950,005 | A | 8/1990 | Cudd |
| 4,974,883 | A | 12/1990 | Jans |
| 4,988,133 | A | 1/1991 | Shih |
| 5,123,684 | A | 6/1992 | Yeh |
| 5,201,200 | A | 4/1993 | Hauber |
| 5,259,652 | A | 11/1993 | Adams et al. |
| 5,308,131 | A | 5/1994 | Galindo et al. |
| 5,395,144 | A | 3/1995 | Galindo |
| 5,604,970 | A | 2/1997 | Aigner et al. |
| 5,676,407 | A | 10/1997 | Smallegan et al. |
| 5,678,870 | A | 10/1997 | Pelletier |
| 6,349,982 | B2 | 2/2002 | Fayngersh et al. |
| 6,393,878 | B1 * | 5/2002 | Fayngersh et al. ..... 70/107 |
| 7,108,300 | B2 * | 9/2006 | Hodgin et al. ..... 292/244 |
| 7,232,161 | B2 | 6/2007 | Matsuda et al. |
| 7,510,222 | B2 | 3/2009 | Hodgin et al. |

FOREIGN PATENT DOCUMENTS

| | | |
|---|---|---|
| DE | 2031370 | 12/1971 |
| DE | 2136636 | 2/1973 |
| DE | 2160563 | 6/1973 |
| DE | 2827939 | 1/1980 |
| NO | 63812 | 8/1941 |
| WO | 9425709 | 11/1994 |

OTHER PUBLICATIONS

Yale Security Inc., PCT International Search Report, issued in corresponding International Patent Application No. PCT/US2005/031013, Jun. 8, 2006.

Yale Security Inc., PCT Written Opinion, issued in corresponding International Patent Application No. PCT/US2005/031013, Jun. 8, 2006.

United States Patent and Trademark Office, Non-Final Office Action issued in U.S. Appl. No. 10/248,889, dated Jun. 16, 2004.

United States Patent and Trademark Office, Non-Final Office Action issued in U.S. Appl. No. 10/248,889, dated Feb. 16, 2005.

United States Patent and Trademark Office, Final Office Action issued in U.S. Appl. No. 10/248,889, dated Oct. 27, 2005.

United States Patent and Trademark Office, Non-Final Office Action issued in U.S. Appl. No. 11/426,751 dated Aug. 10, 2006.

United States Patent and Trademark Office, Non-Final Office Action issued in U.S. Appl. No. 11/426,751 dated Jan. 11, 2007.

United States Patent and Trademark Office, Final Office Action issued in U.S. Appl. No. 11/426,751 dated Aug. 23, 2007.

United States Patent and Trademark Office, Non-Final Office Action issued in U.S. Appl. No. 11/426,751 dated Apr. 7, 2008.

United States Patent and Trademark Office, Non-Final Office Action issued in U.S. Appl. No. 12/415,693 dated Jun. 21, 2010.

United States Patent and Trademark Office, Non-Final Office Action issued in U.S. Appl. No. 12/415,693 dated Feb. 1, 2011.

Yale Security Inc., Canadian Patent Application No. 2,620,562, Office Action, Apr. 19, 2012.

* cited by examiner

REVERSIBLE LATCH BOLT

CROSS-REFERENCE TO RELATED APPLICATIONS

This application is a continuation-in-part application of U.S. application Ser. No. 10/248,889, filed Feb. 27, 2003, the contents of which are hereby incorporated by reference.

BACKGROUND

This invention relates generally to door latch assemblies, and more particularly to a reversible latch bolt for use with latch assemblies in mortise locks so that the mortise lock can be used with both right-hand and left-hand doors.

A mortise lock fits into a mortised recess formed in the edge of a door which is opposite to the edge of the door that is hinged to the door frame. The mortise lock generally includes a rectangular housing, or case, which encloses the lock components. The principal lock component is a beveled latch bolt which projects beyond the edge of the door and into an opening or strike plate in the door frame to latch the door in a closed position. The latch bolt is moveable to a retracted position inside the case to permit opening of the door by operation of a latch operator, such as a door knob or lever handle.

Adjustments must be made to the mortise lock depending on whether the lock is mounted in a left-hand or right-hand door. A mortise lock mounted in a left-hand door must be rotated 180° about a vertical axis for mounting in a right-hand door. Consequently, the latch bolt must also be rotated 180° about a horizontal axis so that the beveled face of the latch bolt faces the door-closing direction.

Ideally, the necessary adjustments to the mortise lock can be accomplished without opening the case. Typically, the latch bolt can be pulled partially out of the housing, usually against the force of a spring, rotated 180° and then allowed to be pulled back into the housing by the spring. However, this arrangement can lead to tampering after the lock is installed since the latch bolt can be reversed even when the mortise lock is in the door, which would prevent the door from the closing. Moreover, the conventional mechanisms for reversing the operation of the locking mechanism are complicated and difficult to manipulate.

For the foregoing reasons, there is a need for a latch assembly for use in a reversible mortise lock which includes a latch bolt that cannot be reversed after the lock is installed in a door. Reversal of the latch bolt for use with a door of the opposite hand should be easily accomplished in the field. The new latch assembly should be straightforward to manufacture and use.

SUMMARY

According to the present invention, a latch assembly is provided, comprising a first portion defining an opening through the first portion and a second portion slidably disposed in the opening in the first portion for relative axial movement of the first portion along the second portion. The second portion includes a stop which is larger than the opening in the first portion for preventing further movement of the first portion along the second portion in a first direction. A securing element releasably connects the first portion and the second portion in a first relative axially connected position where the first and second portions of the latch assembly are movable together. Disconnecting the first portion from the second portion allows the first portion to move along the second portion in the first direction to a second relative axial position where the first portion of the latch assembly is rotatable relative to the second portion such that the first portion may be rotated to a selected position and returned along the second portion in a second direction to the first axially connected position of the first and second portions of the latch assembly.

Also according to the present invention, a mortise lock is provided, comprising a housing including two principal side walls and edge walls extending between and interconnecting the side walls. One of the side walls and one of the edge walls of the housing each have at least one opening. A latch bolt is mounted in the housing for movement with respect to the housing. The latch bolt includes a head portion defining an opening through the head portion and a rod portion slidably disposed in the opening in the head portion for relative axial movement of the head portion along the rod portion. The rod portion comprises a stop which is larger than the opening in the head portion for preventing further movement of the head portion along the rod portion in a first direction. A securing element releasably connects the head portion and the rod portion in a first relative axially connected position where the head portion and the rod portion of the latch bolt are movable together. The head portion and the rod portion of the latch bolt in the first axially connected position are movable relative to the housing so that the head portion at least partially non-rotatably projects outwardly from the opening in the edge wall of the housing in an extended position of the latch bolt and the head portion is inside the housing in a retracted position of the latch bolt. Disconnecting the head portion from the rod portion allows the head portion to move along the rod portion in the first direction to a second relative axial position where the head portion of the latch bolt extends further outwardly from the opening in the edge wall of the housing so that the head portion is rotatable relative to the housing such that the head portion may be rotated to a selected position and returned along the rod portion to the first axially connected position of the head portion and the rod portion of the latch bolt.

BRIEF DESCRIPTION OF THE DRAWINGS

For a more complete understanding of the present invention, reference should now be had to the embodiments shown in the accompanying drawings and described below.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

The latch bolt assembly according to the present invention is for use in a mortise lock and may be used with any conventional mortise lock such as, for example, the mortise locks described by U.S. Pat. Nos. 4,118,056; 5,678,870; 6,349,982 and 6,393,878, the contents of all which are hereby incorporated by reference. Accordingly, detailed explanations of the functioning of all of the mortise lock components are deemed unnecessary for an understanding of the present invention by one of ordinary skill in the art.

Figure 1:
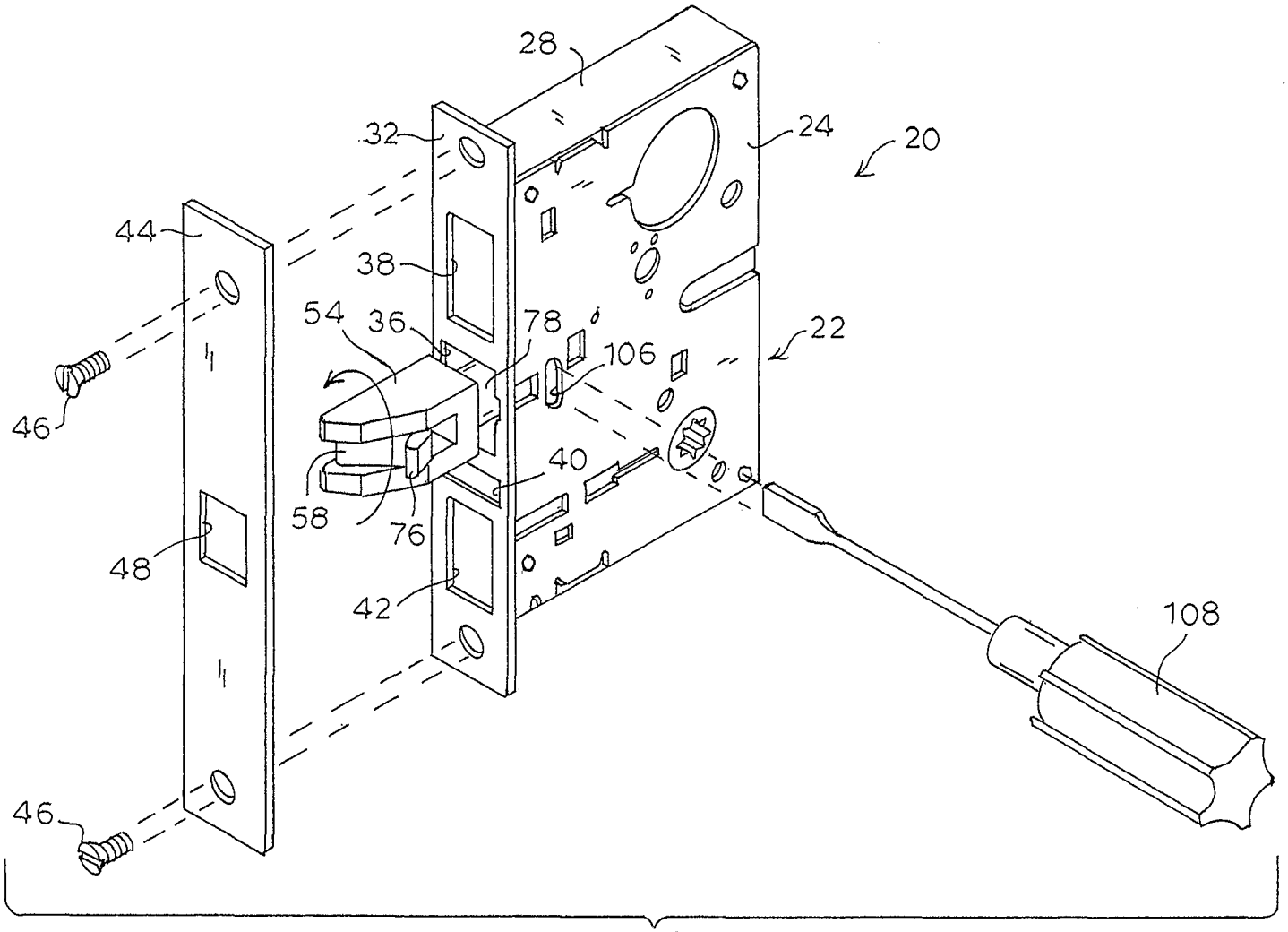
FIG. 1 is a partially exploded perspective view of an embodiment of a mortise lock assembly according to the present invention.

Referring now to FIG. 1, a mortise lock according to the present invention is shown and is generally designated by reference numeral 20. The lock 20 comprises a generally rectangular box, or case 22, for housing the lock components and is adapted to be received in a mortise in the free, or unhinged, edge of a door (not shown). One of the side walls of the case 22 comprises a cap 24 which is secured to and forms a closure for the case 22.

Figure 2:
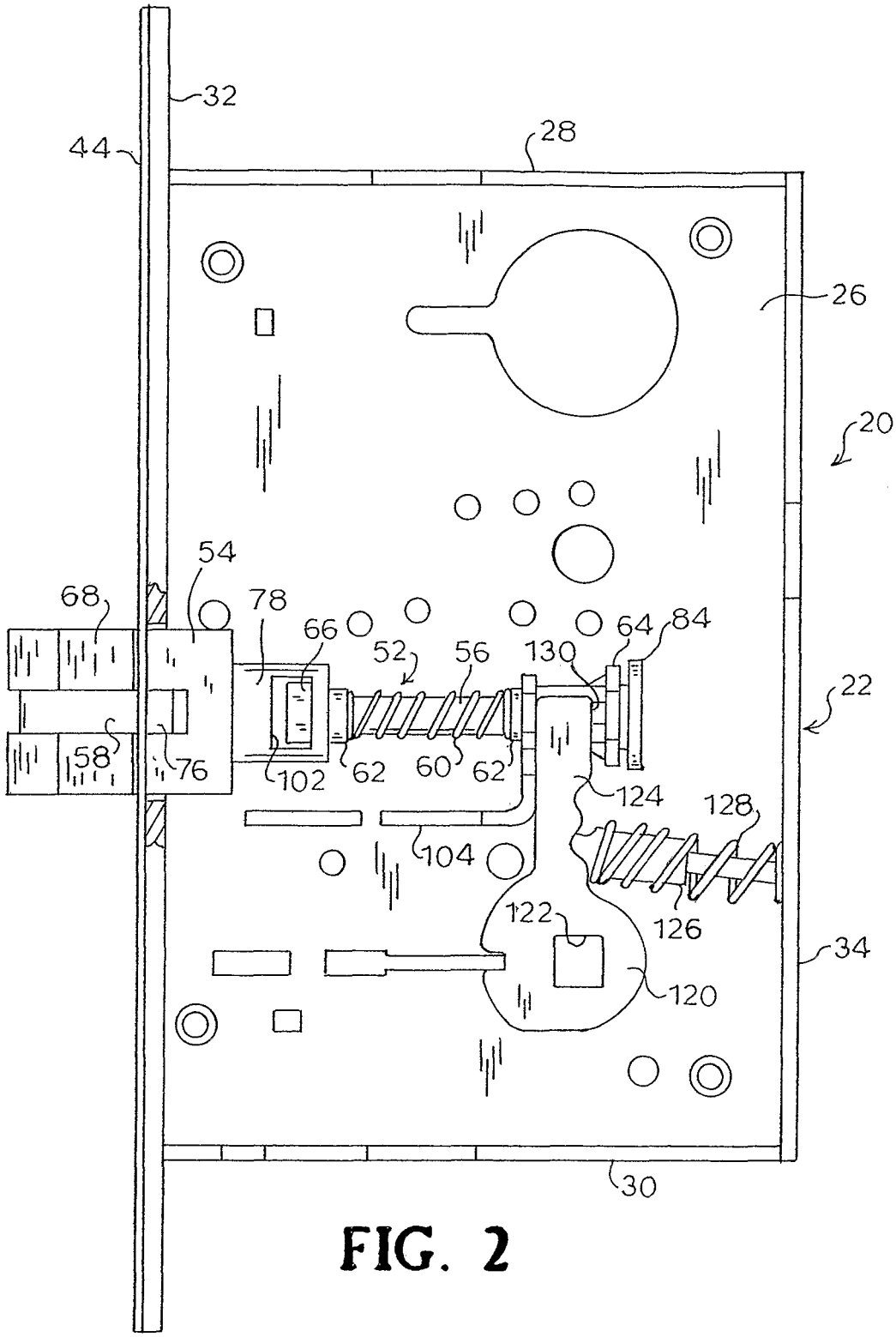
FIG. 2 is a side elevation view of the mortise lock assembly of FIG. 1 with a side wall removed.

FIG. 2 shows the mortise lock 20 with the cap side wall 24 removed. The case 22 includes a side wall 26 and integral top 28, bottom 30, front 32 and rear 34 walls. As seen in FIG. 1, the front wall 32 has a latch bolt opening 36, a deadbolt opening 38, an auxiliary bolt opening 40 and an opening 42 for a flush-mounted toggle. A face plate 44 is secured with screws 46 to the front wall 32 of the case 22 and has an opening 48 for the latch bolt corresponding to the latch bolt opening 36 in the case 22. It is understood that other openings can be provided in the face plate 44 which correspond to the openings in the front wall 42 when the associated lock components are present.

Figure 3:
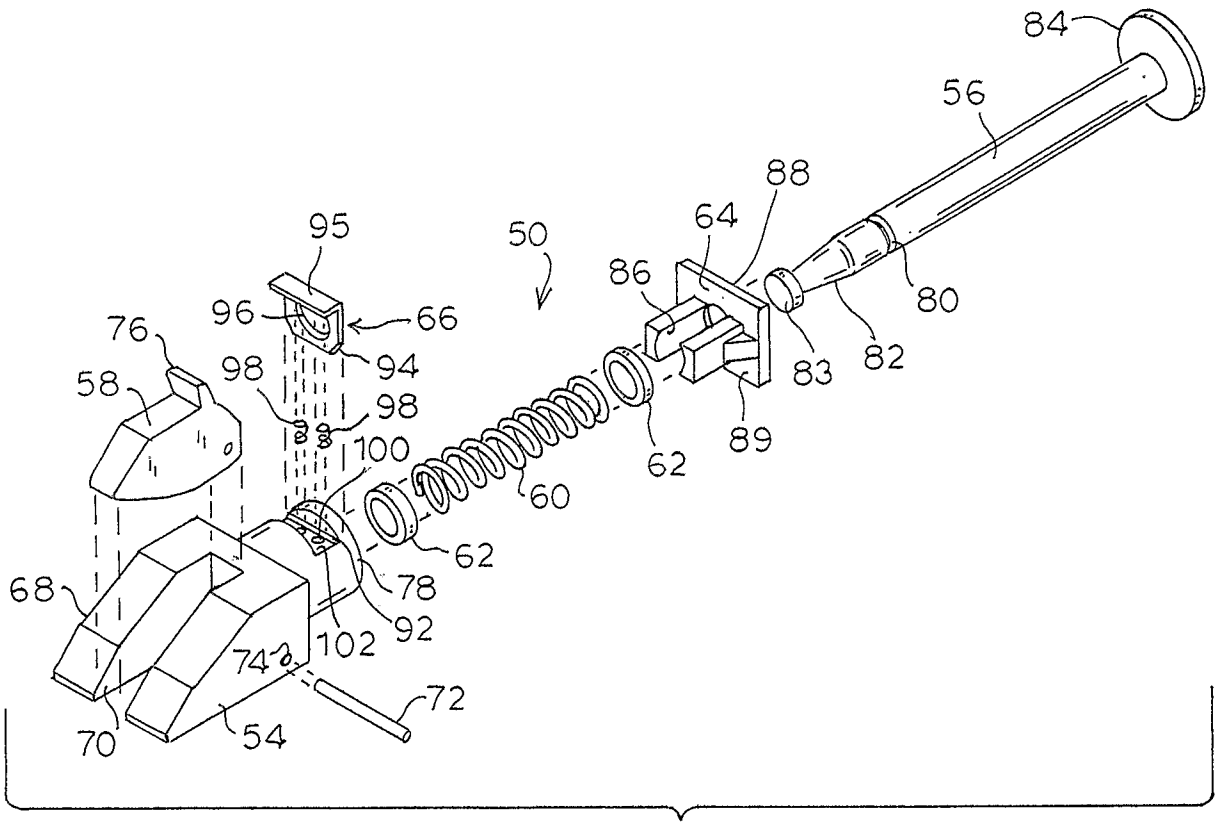
FIG. 3 is an exploded perspective view of a latch assembly according to the present invention and used in the mortise lock assembly of FIG. 1.

An embodiment of the latch assembly according to the present invention is shown in FIG. 3 and designated generally at 50. The latch assembly 50 comprises a latch bolt including a bolt head 54 and a latch tail 56, an anti-friction lever 58, a coil spring 60, spring washers 62, a guide block 64 and a spring clip 66. The bolt head 54 includes a beveled face 68 and a slot 70. A pin 72 extends through a hole 74 in the bolt head 54, into the slot 70 and a hole 75 in the anti-friction lever 58 for pivotally mounting the anti-friction lever to the bolt head 54. An arm 76 extends from one side of the anti-friction lever and transversely from the beveled face 68 of the bolt head 54. When the latch assembly 50 is in the case (FIGS. 2 and 4), the arm 76 engages behind the face plate 44. The inner end 78 of the bolt head 54 is generally cylindrical and has an axial bore 79 (not seen in FIG. 3) for receiving the outer end of the latch tail 56.

The latch tail 56 has a cylindrical body and a circumferential groove 80 adjacent the outer end of the latch tail 56. The body of the latch tail 56 tapers inwardly beginning at a point spaced longitudinally outwardly from the groove 80. The tapered portion 82 of the latch tail 56 terminates at the outer end of the latch tail 56 forming a disc-like outer end 83 to the latch tail 56. A tail plate 84 is fixed to the inner end of the latch tail 56 transversely to the axis of the latch tail 56.

The guide block 64 is generally cube-shaped and has a pass-through opening 86 for slidably receiving the latch tail 56. The sides of the base 88 of the guide block 64 are flat and slide against the side walls 24, 26 of the case 22 for supporting linear movement of the latch tail 56. The front surface of the base 88 of the guide block 64 serves as a retraction surface 89.

The spring clip 66 is an L-shaped piece, the longer leg 94 of the spring clip defining a circular opening 96. The inner end 78 of the bolt head 54 has a transverse slot 92 for receiving the spring clip 66 and which intersects the axial latch tail bore 79. Two coil springs 98 are disposed in depressions 100 in a transverse channel 102 in the inner end of the bolt head 78.

Figure 4:
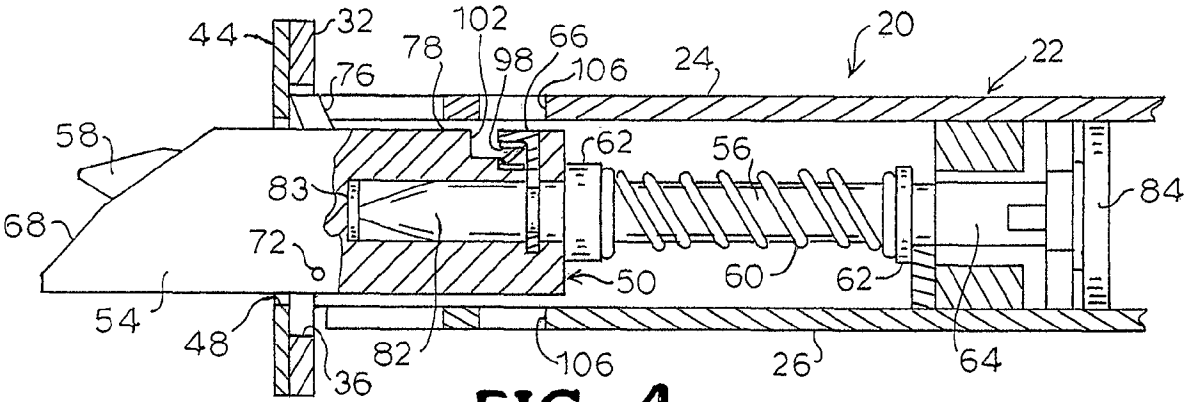
FIG. 4 is a longitudinal sectional view of the latch assembly of FIG. 3 in the mortise lock.

In FIGS. 2 and 4, the latch bolt is shown in an extended position in the mortise lock 20 with the bolt head 54 partially projecting from the opening 36 in the front wall 32 and face plate 44. The latch tail 56 extends rearwardly from the bolt head 54 through a guide slot formed in a boss 104 fixedly mounted between the side walls 24, 26 for guiding and supporting the linear reciprocal movement of the latch bolt. The spring clip 66 is disposed in the slot 92 in the bolt head 54 such that the opening 96 in the spring clip 66 aligns with the axial bore 79 in the bolt head 54. The springs 98 under the shorter leg 95 of the spring clip 66 bias the spring clip 66 away from the bolt head 54. As shown in FIG. 4, the edge of the spring clip opening 96 fits into the groove 80 in the latch tail 56. The bolt head 54 and latch tail 56 are thus secured to move together during normal operation of the mortise lock 20. The coil spring 60 is held in compression between the bolt head 54 and the boss 104 for biasing the latch bolt outwardly to the extended position.

As is conventional, the latch bolt is moveable in the openings in the front wall 32 of the case 22 and face plate 44 to the retracted position inside the case 22 by operation of a latch operator comprising either an inside or outside knob or lever handle or a cylinder lock (not shown). In the embodiment shown, retracting means comprises at least one rollback hub 120 rotatably mounted in the case 22 below the latch assembly 50 (FIG. 2). The hub 120 includes a square aperture 122 for non-rotatable connection to a spindle drive (not shown) connected to the knobs or lever handles for rotating the hub 120. The hub 120 has an upwardly extending leg 124. The upper portion of the leg 124 has a rearwardly facing bearing surface 130 for engaging the front retraction surface 89 of the guide block 64. The latch bolt is retracted by rotating the hub 120 in a clockwise direction, as seen in FIG. 2. Rotation of the hub 120 causes the bearing surface 130 to engage the retraction surface 89 of the guide block 64 to move the latch bolt linearly inward to the retracted position. A spring arm 126 is mounted transversely in the rear wall 34 of the case 22. A coil spring 128 fits around the arm 126 and acts between the rear wall 34 and the hub 120 to urge the hub 120 toward engagement with the boss 104 for restoring the hub 120 to the neutral or home position, shown in FIG. 2, when the latch operator is released. It is understood that the mortise lock assembly may have independent hubs to which inside and outside spindle drives are connected, respectively.

In addition, the latch bolt automatically retracts when the anti-friction lever 58 and the beveled face 68 of the bolt head 54 engage the door frame or strike upon closing of the door. Initially, the anti-friction lever 58 engages the door frame pivoting the anti-friction lever on the pin 72 in the bolt head 54. As the anti-friction lever 58 pivots, the arm 76 works against the inner surface of the face plate 44 driving the latch bolt 52 rearward into the case 22. When the latch operator is released, or the door is in the door frame, the coil spring 60 returns the latch bolt to the extended position.

According to the present invention, the latch bolt is reversible for use with a door of the opposite hand. In order to reverse the latch bolt, it is necessary to disconnect the bolt head 54 from the latch tail 56, rotate the bolt head 54 relative to the latch tail 56 and the lock case 22, and reconnect the bolt head 54 to the latch tail 56. This operation is shown in FIGS. 1 and 5-7.

Figure 5:
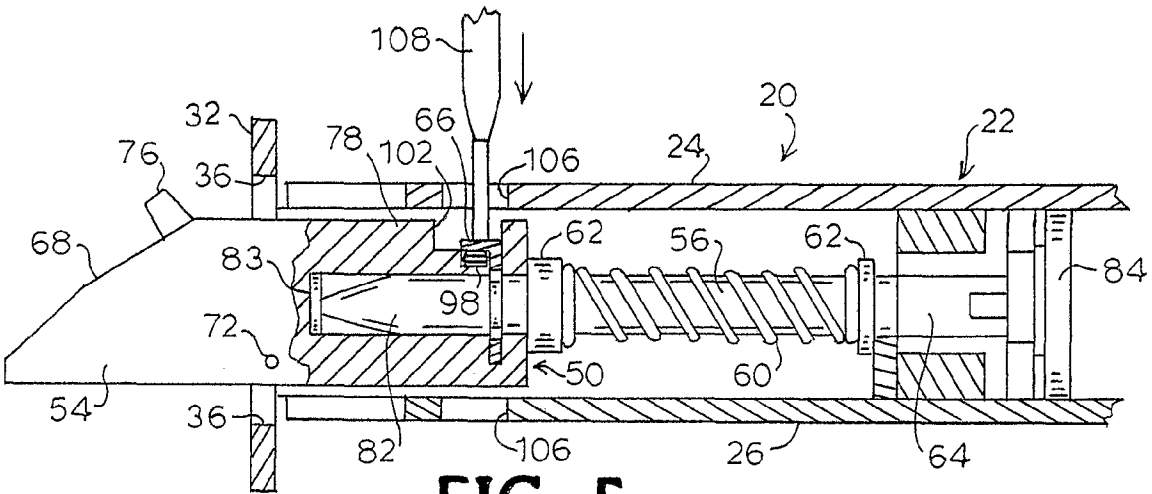
FIGS. 5-7 are longitudinal sectional views of the latch assembly as shown in FIG. 4 for illustrating a method for reversal of the latch bolt according to the present invention.
Figure 6:
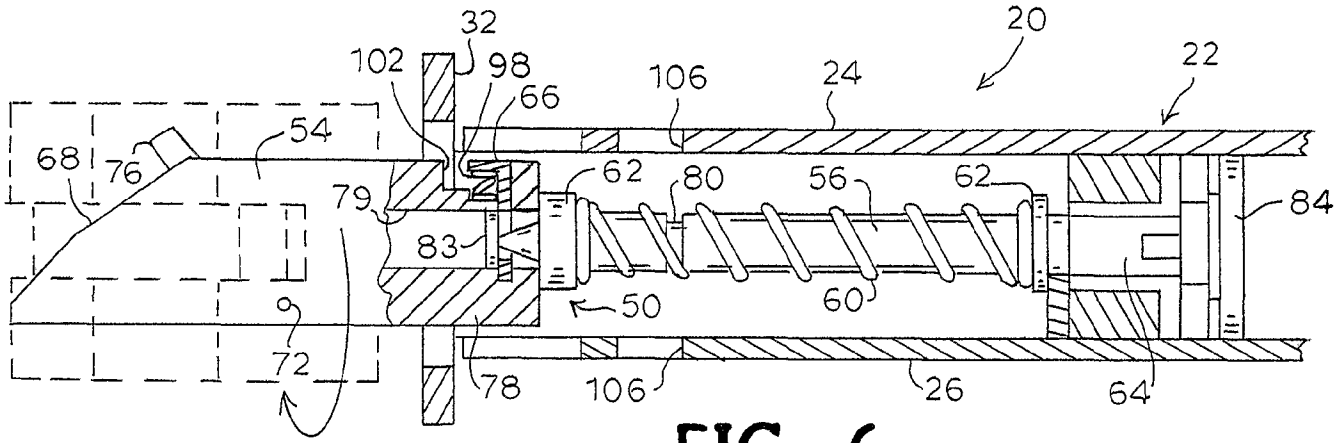

The first step is to remove the face plate 44, as seen in FIG. 1. Next, the spring clip 66 is manually depressed by inserting a tool, such as a screw driver 108, through an opening 106 in the cap side wall 24. As seen in FIG. 5, pressing on the spring clip 66 with a screw driver 108 pushes the spring clip 66 downwardly against the force of the springs 98 thereby aligning the opening 96 in the spring clip 66 and the axial bore 79 in the bolt head 54 freeing the latch tail 56 from the spring clip 66 for movement relative to the bolt head 54. The bolt head 54 is then biased by the spring 60 outwardly of the case 22 through the opening 36 in the front wall 32 (FIGS. 1 and 6). As bolt head 54 moves outward of the case 22, the flange 95 on the spring clip 66 moves out from under the tip of the screwdriver 108. This allows the spring clip 66 to snap outward of the bolt head 54 under the force of the springs 98. As the bolt head 54 continues to move outward, the spring clip 66 advances along the tapered portion 82 of the latch tail 56 until the spring clip engages behind the disc-like outer end 83 of the latch tail 56. In this position, only the inner cylindrical portion 78 of the bolt head 54 remains in the case 22 so that the bolt head 54 is free to rotate on the latch tail 56.

Figure 7:
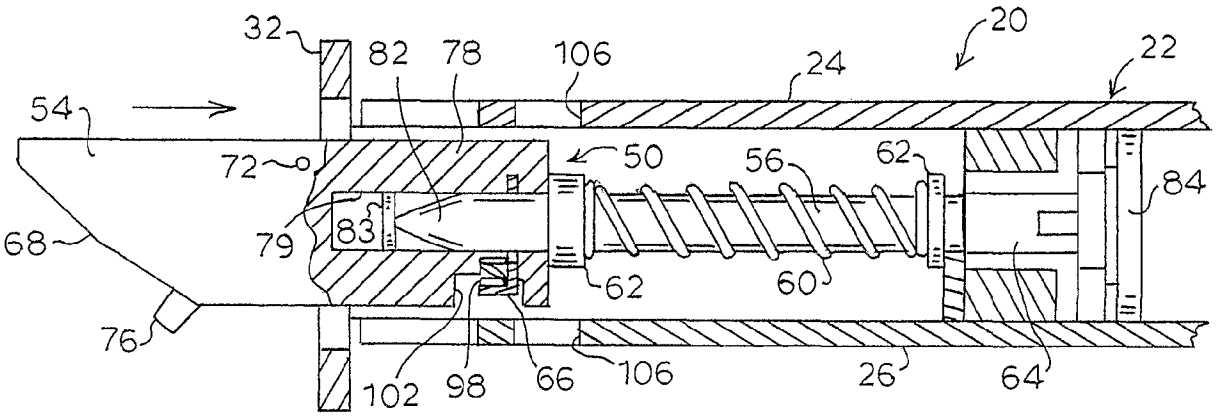

The bolt head 54 is rotated 180° (FIGS. 1 and 6) and pushed back into the case 22. FIG. 7 shows the bolt head 54 during reinsertion into the case 22 along the latch tail 56. Since the outer end of the latch tail 56 is already in the axial bore 79 in the bolt head 54, reinsertion of the bolt head 54 is guided by the latch tail 56. As the bolt head 54 moves into the case 22 along the latch tail 56, the edge of the opening 96 in the spring clip 66 engages and advances along the tapered portion 82 of the latch tail 56 forcing the spring clip 66 into the slot 92 (as seen in FIG. 7) against the force of the springs 98. The bolt head 54 is advanced into the case 22 until the relative position of the bolt head 54 and latch tail 56 is such that the spring clip 66 is again received in the circumferential groove 80 in the latch tail 56 securing the bolt head 54 and latch tail 56. The face plate 44 is replaced such that the arm 76 on the anti-friction latch 58 is behind the face plate 44. It is understood that the spring clip 66 is now accessible through an opening 106 in the cap side wall 26 in the event that the user desires to reverse the described process and return the bolt head 54 to the prior position.

Figure 8:
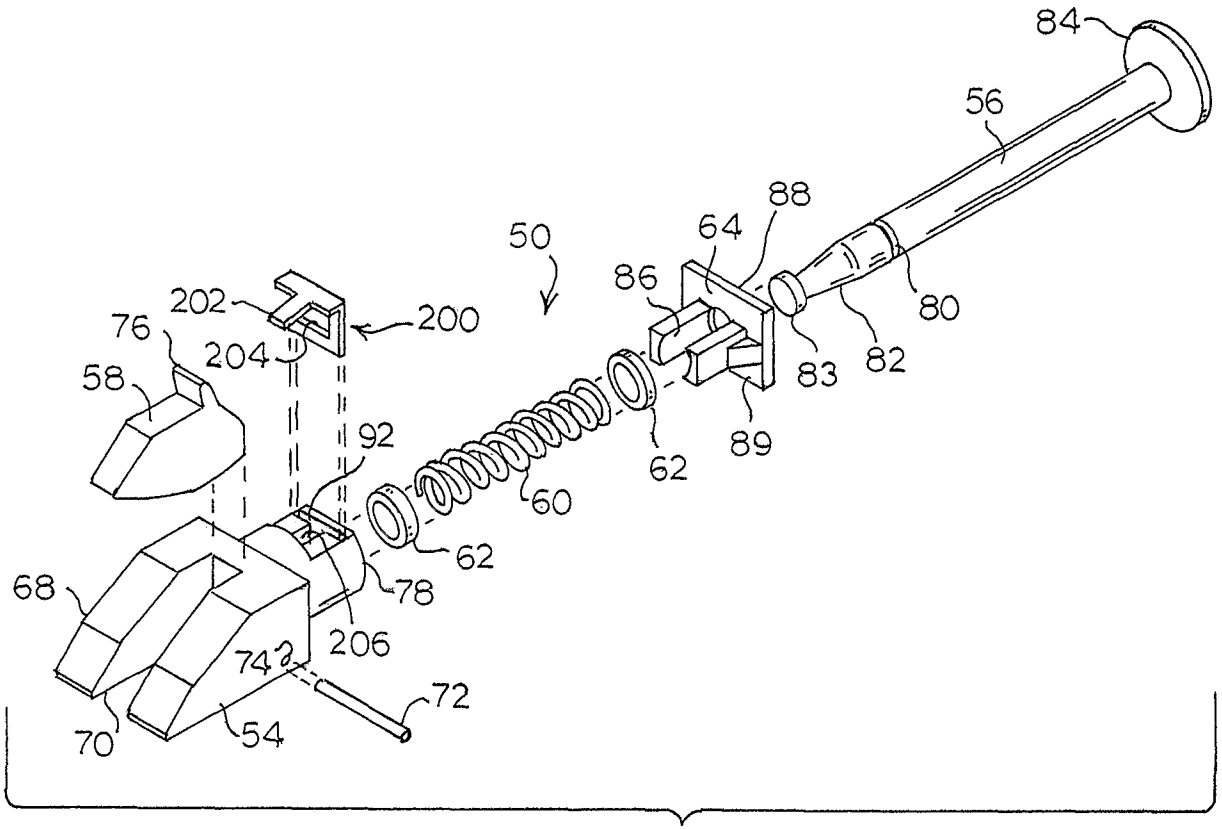
FIG. 8 is an exploded perspective view of a second embodiment of a latch assembly according to the present invention and used in the mortise lock assembly of FIG. 1.

It is understood that the embodiments of the inner portion 78 of the bolt head 54 and the spring clip 66 are exemplary and other structures are possible, as long as such other structures releasably hold the bolt head 54 and latch tail 56 for movement together and, when released, allows the bolt head 54 to move axially relative to the latch tail 56 and rotatably relative to the case 22 without disconnection from the latch tail 56. Other means for biasing the spring clip 66 to the position where the spring clip 66 partially blocks the axial bore 79 in the bolt head 54 are possible. For example, FIG. 8 shows an alternative embodiment of the spring clip for use in the latch assembly 50 of the present invention, generally designated at 200. This embodiment of the spring clip includes an angled tab 202 extending from one edge of the spring clip 200. The spring clip tab 202 works against a surface 206 of the inner end 78 of the bolt head 54. This embodiment of the spring clip 200 functions without the coil springs 98 if the material of the spring clip is flexible enough to allow the clip 200 to be pushed down to align the opening 204 in the spring clip 200 with the bolt head bore 79. Thus, we do not intend to limit ourselves to the specific embodiments of the bolt head and spring clip, or the spring clip biasing means, shown herein.

Figure 9:
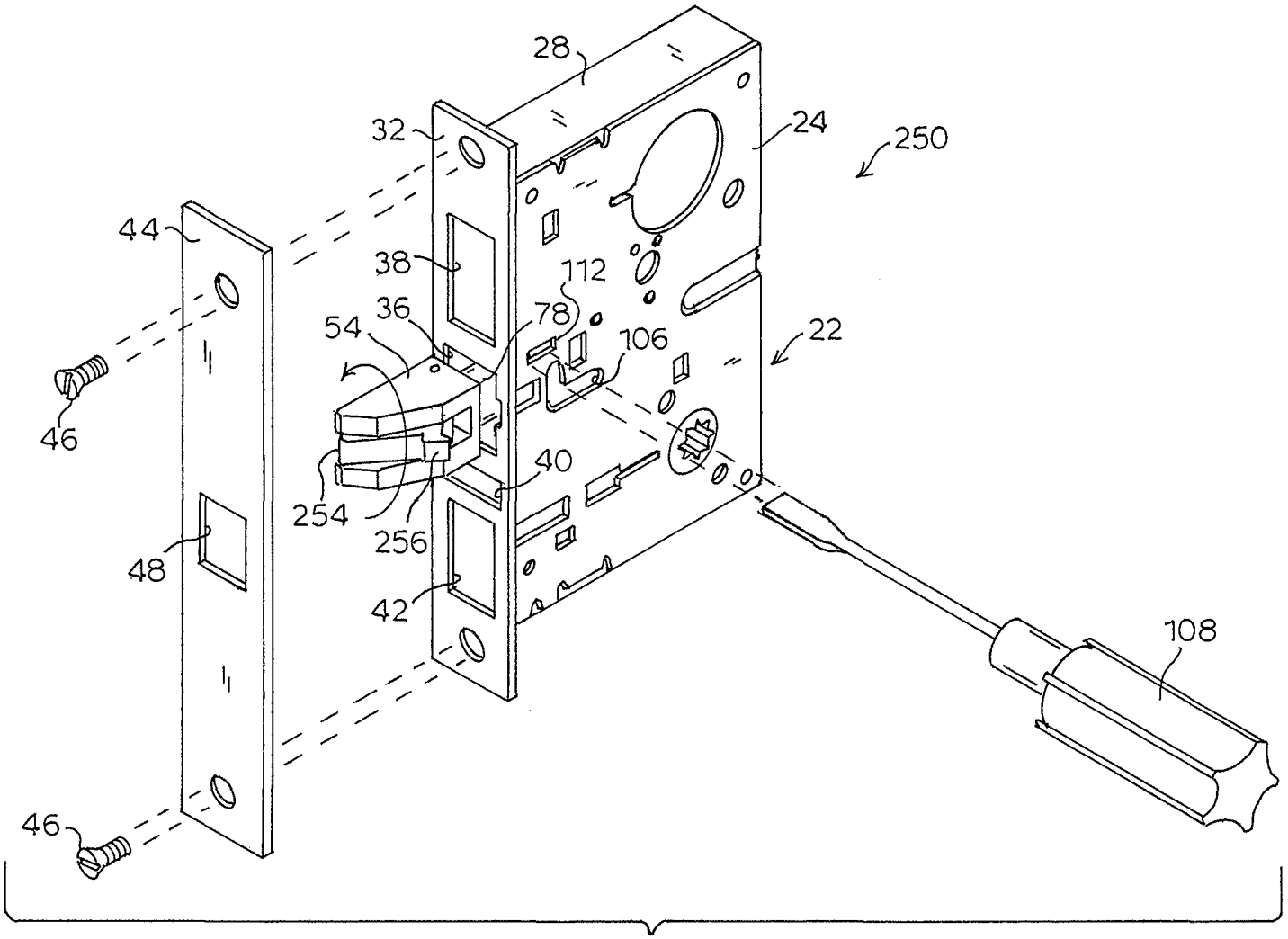
FIG. 9 is a partially exploded perspective view of a second embodiment of a mortise lock assembly according to the present invention.
Figure 10:
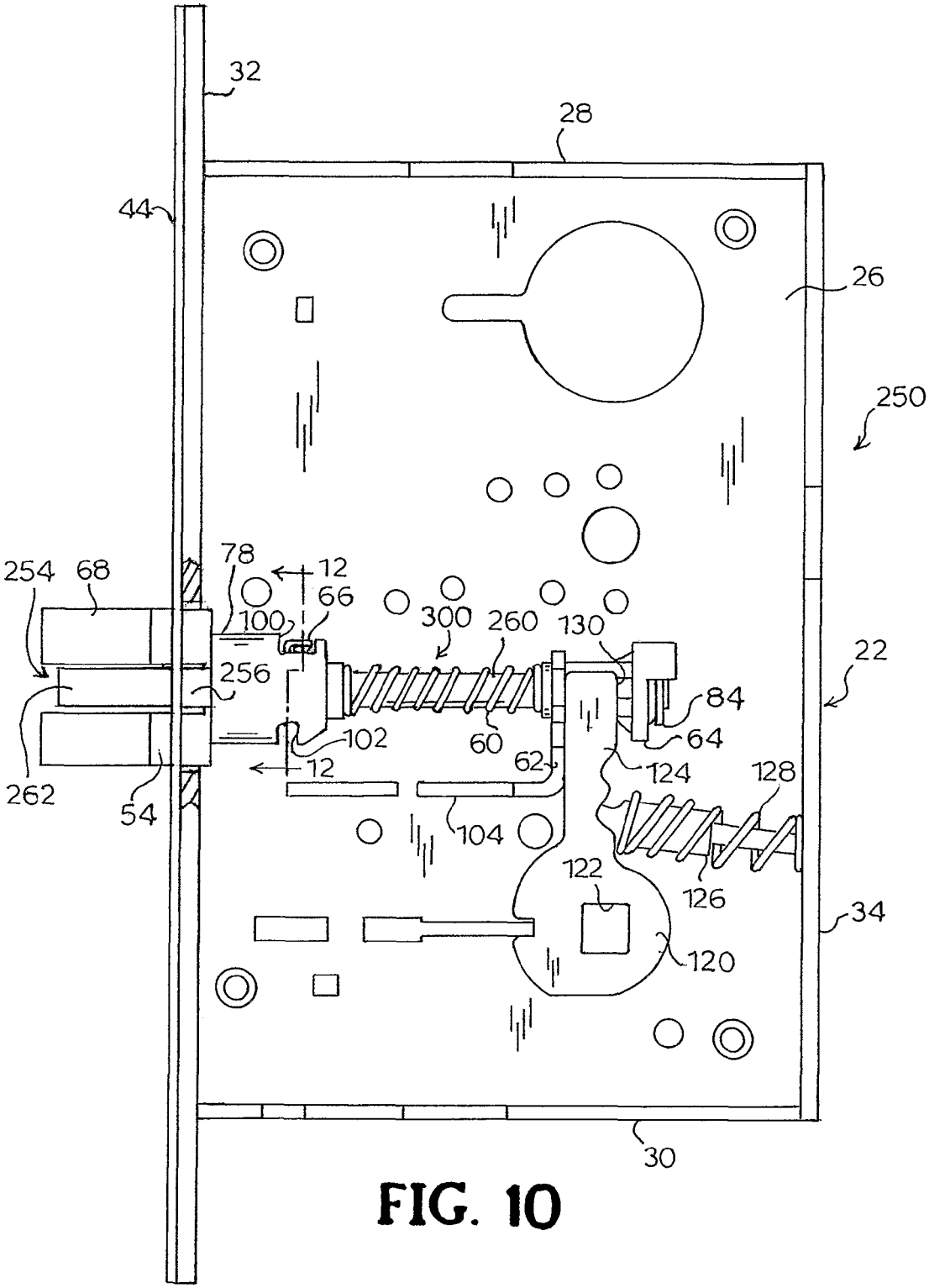
FIG. 10 is a side elevation view of the mortise lock assembly of FIG. 9 with a side wall removed.

Referring to FIGS. 9 and 10, a mortise lock according to a second embodiment of the present invention is shown and is generally designated by reference numeral 250. A second embodiment of a latch assembly according to the present invention is disposed in the mortise lock 250 and designated generally at 300. For convenience and to avoid repetition, the same reference numbers are used to identify the same elements as described in the previous embodiments of the mortise lock 20 and the latch assembly 50.

Figure 11:
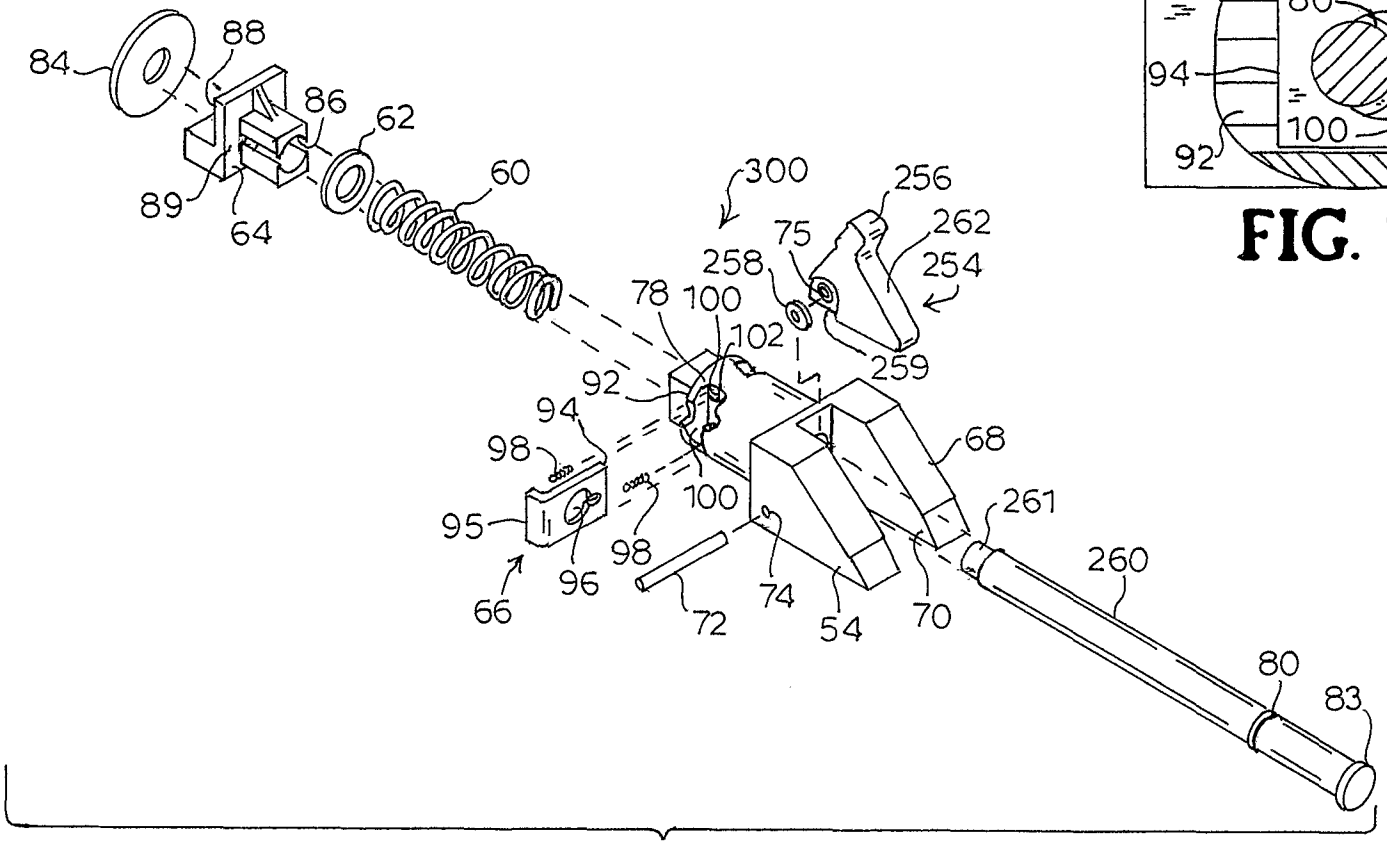
FIG. 11 is an exploded perspective view of an embodiment of a latch assembly according to the present invention and used in the mortise lock assembly of FIG. 9.

As shown in FIG. 11, the second embodiment of the latch assembly 300 comprises several different components, including another embodiment of an anti-friction lever 254 and a latch tail 260. Referring now to FIGS. 17-23, the anti-friction lever 254 is a generally V-shaped piece. The legs of the "V" comprise a front edge 262 and a rear edge 264 of the anti-friction lever 254. A coplanar arm 256 extends perpendicularly from the distal end of the front edge 262 of the anti-friction lever 254. A coplanar shoulder 257 extends distally from the distal end of the rear edge 264 of the anti-friction lever 254. A hole 75 is provided in the anti-friction lever 254 at the distal end of the rear edge 264 adjacent to the shoulder 257. As best seen in FIG. 11, the hole receives the pin 72 which passes through a corresponding hole 74 in the bolt head 54 for pivotally mounting the anti-friction lever 254 in the slot 70 in the bolt head 54. A lock washer 258 is disposed on the pin 72 between the bolt head 54 and the anti-friction lever 254. The lock washer 258 is received in a corresponding depression 259 in the surface of the anti-friction lever 254 surrounding the hole 75.

Referring again to FIGS. 9 and 10, when the anti-friction lever 254 is mounted in the bolt head 54, the arm 256 extends transversely from the beveled face 68 of the bolt head 54. When the latch assembly 300 is in the case 22 (FIGS. 10 and 13), the arm 256 engages behind the face plate 44. The latch bolt automatically retracts when the front edge 262 of the anti-friction lever 254 and the beveled face 68 of the bolt head 54 engage the door frame or strike upon closing of the door, as described above with respect to the first embodiment of the latch assembly 50. As the anti-friction lever 254 pivots, the arm 256 works against the inner surface of the face plate 44 driving the latch bolt rearward into the case 22. Further, the size and shape of the anti-friction lever 254 relative to the bolt head 54, and the point of connection of the anti-friction lever 254 to the bolt head 54, limits the rotational movement of the anti-friction lever 254. Specifically, as best seen in FIG. 9, the anti-friction lever 254 will rotate in a clockwise direction only to a point such that rear edge 264 of the anti-friction is substantially flush with the rear surface of the bolt head 54, even with the face plate 44 removed. Moreover, this configuration will allow the automatic retraction of the latch bolt even with the face plate 44 removed. In other words, the front edge 262 of the anti-friction lever 254 and the beveled face 68 of the bolt head 54 will engage the door frame or strike upon closing of the door for driving the latch bolt rearward into the case 22.

Referring again to FIG. 11, the latch tail 260 has a cylindrical body of uniform diameter and a circumferential groove 80 formed in the body adjacent the outer end 83 of the latch tail 260. The disc-like outer end 83 of the latch tail 260 has a slightly larger diameter than the body of the latch tail 260. The inner end 261 of the latch tail 260 has a slightly smaller diameter than the diameter of the latch tail 260. The bolt head 54 has an axial through bore 290 for receiving the latch tail 260. The inner end of the through bore 290 has a slightly smaller diameter than the outer end, forming a shoulder 296. During assembly, the latch tail 260 is inserted into the outer end of the through bore 290 in the slot in the bolt ehad 54. between the into the through bore 290 of the bolt head 54. The latch tail 260 slides freely in the bolt head 54 until the inner end 261 of the latch tail 260 extends inwardly from the inner inner cylindrical portion 78 of the bolt head 54. The inward movement of the latch tail 260 is limited by engagement of the larger diameter outer end 83 of the latch tail 260 with the shoulder 296 in the through bore 290. The inner end 261 of the latch tail 260 is slidingly received in the pass-through opening in the guide block 64. In this embodiment, the tail plate 84 is a rivet that, through an orbital riveting step, is fixed onto the inner end 261 of the latch tail 260 transversely to the axis of the latch tail 260 for completing the latch assembly 300. Only one spring washer 62 is disposed on the latch tail 260 between the coil spring 60 and the guide block 64. The outer end of the coil spring 60 sits against a rectangular extension integral with the inner of the bolt head 54.

Figure 13:
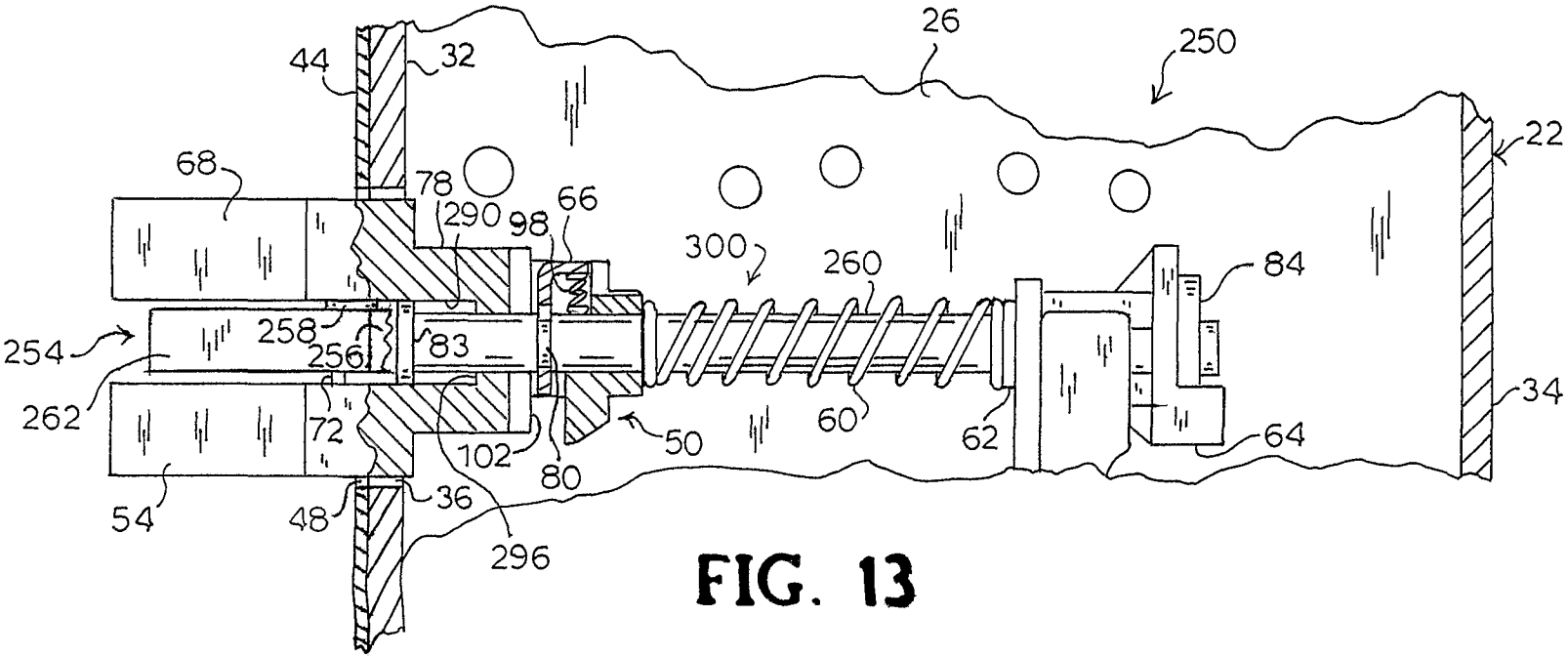
FIG. 13 is a longitudinal sectional view of the latch assembly of FIG. 11 in the mortise lock.

In FIGS. 10 and 13, the latch bolt is shown in an extended position in the mortise lock 250 with the bolt head 54 partially projecting from the opening 36 in the front wall 32 and the opening 48 in the face plate 44. The latch tail 260 extends rearwardly from the bolt head 54 through the guide slot formed in the boss 104 for guiding and supporting the linear reciprocal movement of the latch bolt.

Figure 12:
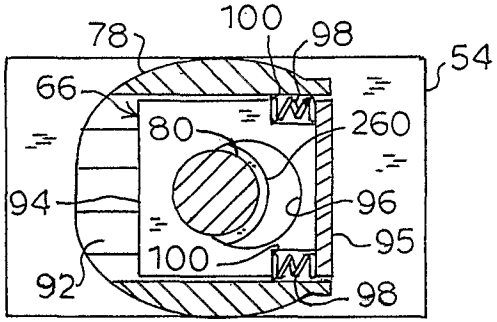
FIG. 12 is a cross-sectional view of the latch assembly of FIG. 10 taken along lines 12-12.

The spring clip 66 is disposed in the slot 92 in the bolt head 54 such that the opening 96 in the spring clip 66 is at least partially aligned with the axial through bore 290 in the bolt head 54 for receiving the latch tail 260. As shown in FIG. 12, the edge of the spring clip 66 defining the opening 96 fits into the groove 80 in the latch tail 260. The springs 98 disposed under the shorter leg 95 of the spring clip 66 bias the spring clip 66 away from the bolt head 54 for securing the bolt head 54 and the latch tail 260 for movement together during normal operation of the mortise lock 250. The latch bolt is moveable in the openings 36, 48 in the front wall 32 of the case 22 and face plate 44 to the retracted position inside the case 22 by operation of a latch operator (not shown), as described above with respect to the first embodiment of the mortise lock 20 and latch assembly 50.

According to the present invention, the latch bolt is reversible for use with a door of the opposite hand. In order to reverse the latch bolt, it is necessary to disconnect the bolt head 54 from the latch tail 260 for movement along the latch tail 260, rotate the bolt head 54 relative to the latch tail 260 and the lock case 22, and reconnect the bolt head 54 to the latch tail 260 for movement together with the latch tail 260. This operation is shown in FIGS. 9 and 14-16.

Figure 14:
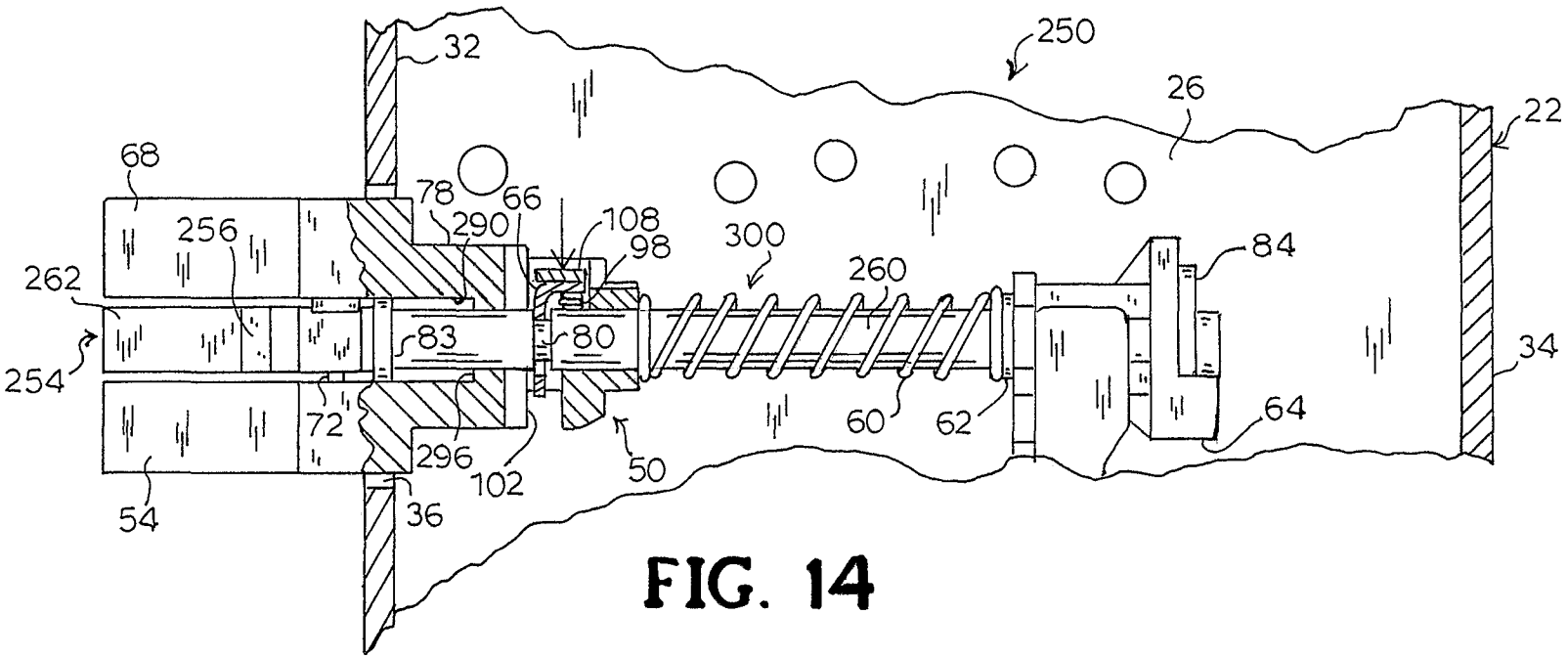
FIGS. 14-16 are longitudinal sectional views of the latch assembly as shown in FIG. 9 for illustrating a method for reversal of the latch bolt according to the present invention.
Figure 15:
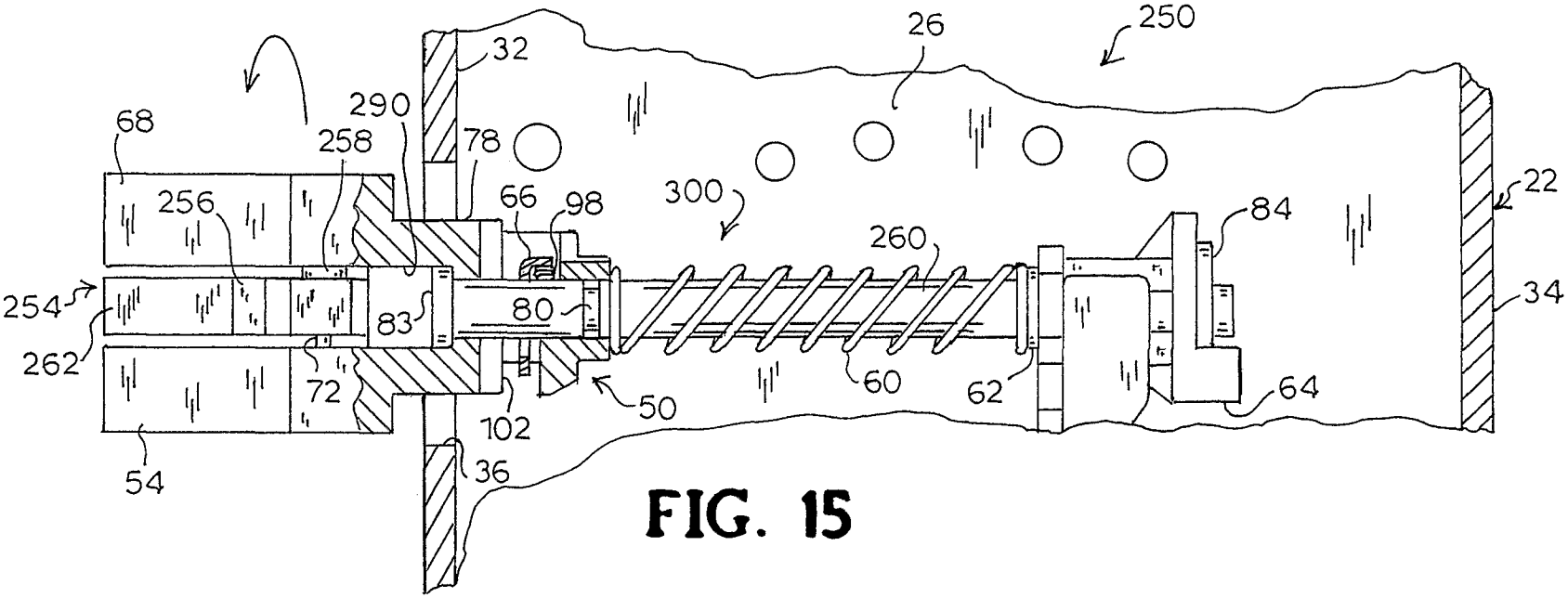

The first step is to remove the face plate 44, as seen in FIG. 9. The cap side wall 24 has an opening 112 which allows access to the spring clip 66 according to the second embodiment of the present invention. The spring clip 66 is manually depressed by inserting a tool, such as a screw driver 108, through the opening 112 (FIG. 14). Because the spring clip 66 reciprocates in a direction parallel to the side walls 24, 26 of the case 22, the opening 112 is sized to allow the broad side of the blade of the screwdriver 108 to engage the short leg 95 of the spring clip 66. As seen in FIG. 14, pressing on the spring clip 66 with the blade of the screw driver 108 pushes the spring clip 66 downwardly against the force of the springs 98 thereby aligning the opening 96 in the spring clip 66 and the axial through bore 290 in the bolt head 54, freeing the bolt head 54 and the spring clip 66 for sliding movement relative to the latch tail 260. The bolt head 54 is then biased by the spring 60 outwardly of the case 22 through the opening 36 in the front wall 32 (FIGS. 9 and 15). As the bolt head 54 moves outward of the case 22 along the latch tail 260, the flange 95 on the spring clip 66 moves out from under the blade of the screwdriver 108. As the bolt head 54 continues to move outward, the disc-like outer end 83 of the latch tail 260 engages the shoulder 257 in the latch bolt 54 preventing further outward movement of the bolt head 54. In this position, only the inner cylindrical portion 78 of the bolt head 54 remains in the case 22 so that the bolt head 54 and spring clip 66 are free to rotate on the latch tail 260.

Figure 16:
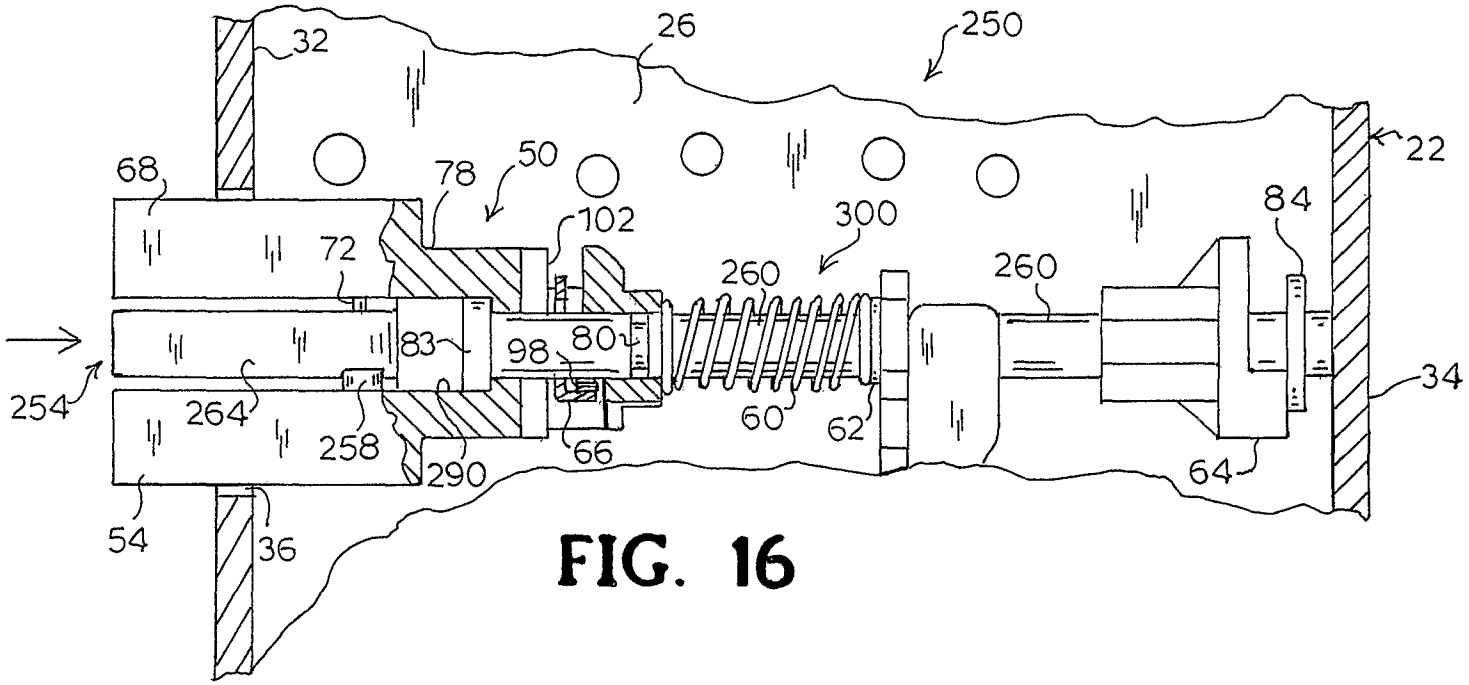
Figure 17:
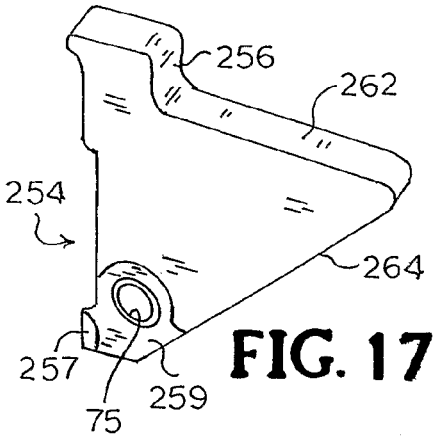
FIG. 17 is a perspective view of an embodiment of an anti-friction lever according to the present invention for use in a latch assembly as shown in FIGS. 9-16.
Figure 18:
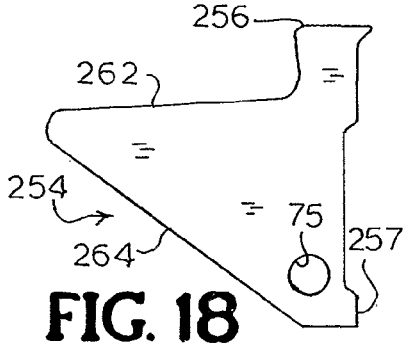
FIG. 18 is a left side elevation view of the anti-friction lever shown in FIG. 17.
Figure 20:
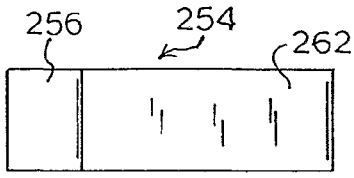
FIG. 20 is a top plan view of the anti-friction lever shown in FIG. 17.
Figure 19:
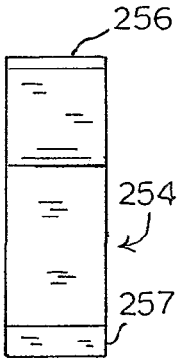
FIG. 19 is a back view of the anti-friction lever shown in FIG. 17.
Figure 21:
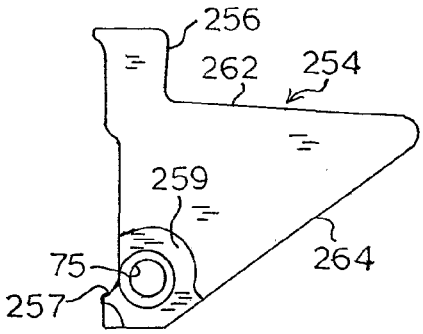
FIG. 21 is a right side elevation view of the anti-friction lever shown in FIG. 17.
Figure 23:
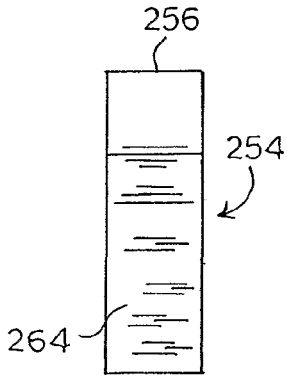
FIG. 23 is a front view of the anti-friction lever shown in FIG. 17.
Figure 22:
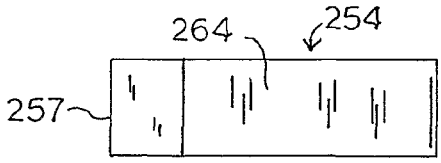
FIG. 22 is a bottom plan view of the anti-friction lever shown in FIG. 17.

The bolt head 54 is rotated 180° (FIGS. 9 and 15) and pushed back into the case 22. As shown in FIG. 16, during reinsertion of the latch bolt, the latch bolt is advanced into the case 22 until the inner end 261 of the latch tail 260 engages the rear wall 34 of the case 22. The bolt head 54 is then pushed inwardly against the force of the spring 60 to a realtive position of the bolt head 54 and latch tail 260 where the spring clip 66 snaps into the circumferential groove 80 in the latch tail 260 under the force of the springs 98 for securing together the bolt head 54 and latch tail 260. Since the outer end 83 of the latch tail 206 is already in the axial through bore 290 in the bolt head 54, reinsertion of the bolt head 54 is guided by the latch tail 260. The face plate 44 is replaced such that the arm 256 on the anti-friction latch 254 is behind the face plate 44. The spring clip 66 is now accessible through an L-shaped opening 106 in the cap side wall 24 in the event that the user desires to reverse the described process and return the bolt head 54 to the prior position.

It is understood that, as with the first embodiment of the latch assembly 50, the embodiments of the inner portion 78 of the bolt head 54 and the spring clip 66 are exemplary and other structures are possible, as long as such other structures releasably hold the bolt head 54 and latch tail 260 for movement together and, when released, allows the bolt head 54 to move axially relative to the latch tail 260 and rotatably relative to the case 22 without disconnection from the latch tail 260. Similarly, other means for biasing the spring clip 66 to the position where the spring clip 66 partially blocks the axial through bore 209 in the bolt head 54 are possible, as shown in FIG. 8. Thus, we do not intend to limit ourselves to the specific embodiments of the bolt head and spring clip, or the spring clip biasing means, shown herein.

The previously described embodiments of the present invention have many advantages, including the provision of a reversible mortise lock which cannot be tampered with after installation. The releasing mechanism of the latch assembly is only accessible through the side walls of the mortise lock case. Therefore, latch bolt reversal must be performed before the lock is installed in the door. Moreover, the latch bolt reversal does not require removal of the entire latch bolt from the case. The mortise lock incorporating the new latch assembly is easily modified for use with either a light-hand door or a left-hand door from outside of the lock casing with a screw driver. The latch assembly is simple to reverse in the field prior to installation in the door.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, several means are possible for releasably securing the latch tail to the bolt head. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A latch assembly, comprising:

a bolt head defining an opening through the bolt head;

a latch tail slidably disposed in the opening in the bolt head for relative axial movement of the bolt head along the latch tail, the latch tail including a stop adjacent an outer end, the stop having a larger cross-sectional area than the remaining portion of the latch tail and which is larger than the cross-sectional area of the opening in the bolt head for preventing further axial movement of the bolt head along the latch tail in a first direction at a first relative axial position of the bolt head and the latch tail where the bolt head engages the stop such that the latch tail cannot be removed from the bolt head in the first direction, and where the bolt head and the latch tail are rotatable relative to one another such that the bolt head may be rotated to a selected position;

a spring clip movably associated with the bolt head and having a blocking surface; and means for biasing the spring clip to a blocking position where the blocking surface partially closes the opening in the bolt head and engages the surface of the latch tail for releasably connecting the latch tail in the opening in the bolt head at a second relative axial position where the bolt head and the latch tail are connected for movement together in both axial directions.

2. A latch assembly as recited in claim 1, wherein the spring clip further comprises a disengaging surface which when pressed moves the spring clip relative to the bolt head and the latch tail against the force of the biasing means to a position where the blocking surface does not engage the latch tail for freeing the bolt head and the latch tail for relative movement between the first relative axial position and the second relative axial position.

3. A latch assembly as recited in claim 1, wherein the latch tail comprises an elongated member.

4. A latch assembly as recited in claim 3, wherein the stop comprises a flange transverse to the longitudinal axis of the elongated member.

5. A latch assembly as recited in claim 4, wherein the flange is disposed at one end of the elongated member.

6. A latch assembly as recited in claim 1, wherein the spring clip comprises a substantially flat plate having an opening for slidably receiving the elongated member and the blocking surface comprises an edge of the plate defining the opening, and wherein the bolt head has a slot transverse to the axis of the opening in the bolt head for receiving the plate so that the openings in the plate and the bolt head are only partially aligned when the biasing means biases the plate into the blocking position.

7. A latch assembly as recited in claim 6, wherein the plate includes a flange extending from the plate, the flange adjacent a surface of the bolt head when the plate is in the slot, and wherein the biasing means comprises a spring disposed between the flange and the surface of the bolt head.

8. A latch assembly as recited in claim 6, wherein the biasing means comprises a resilient tab extending from the periphery of the plate and engaging a surface of the first portion of the latch assembly when the plate is in the slot.

9. A mortise lock, comprising:

a housing including two principal side walls and edge walls extending between and interconnecting the side walls, one of the side walls and one of the edge walls of the housing each having at least one opening; and a latch bolt mounted in the housing for movement with respect to the housing, the latch bolt including a head portion defining an opening through the head portion, a rod portion slidably disposed in the opening in the head portion for relative axial movement of the head portion along the rod portion, the rod portion comprising a stop adjacent an outer end, the stop larger than the opening in the head portion for preventing further axial movement of the head portion along the rod portion in a first direction at a first relative axial position of the head portion and the rod portion where the head portion engages the stop such that the rod portion cannot be removed from the head portion in the first direction, and where the head portion and the rod portion are rotatable relative to one another, a spring clip movably associated with the head portion and having a blocking surface, and means for biasing the spring clip to a blocking position where the blocking surface partially closes the opening in the head portion and engages the surface of the rod portion for releasably connecting the rod portion in the opening in the head portion in a second relative axial position where the head portion and the rod portion of the latch bolt are connected for movement together in both axial directions, wherein the head portion and the rod portion of the latch bolt in the second relative axial position are movable together relative to the housing so that the head portion at least partially non-rotatably projects outwardly from the opening in the edge wall of the housing in an extended position of the latch bolt and the head portion is inside the housing in a retracted position of the latch bolt, and wherein disconnecting the head portion from the rod portion allows the head portion to move along the rod portion in the first direction to the first relative axial position where the head portion of the latch bolt extends further outwardly from the opening in the edge wall of the housing so that the head portion is rotatable relative to the housing such that the head portion may be rotated to a selected position and returned along the rod portion to the second relative axial position where the head portion and the rod portion of the latch bolt are connected.

10. A mortise lock as recited in claim 9, further comprising means for biasing the latch bolt outwardly of the housing.

11. A mortise lock as recited in claim 9, wherein the stop comprises a flange transverse to the longitudinal axis of the rod portion.

12. A mortise lock as recited in claim 11, wherein the flange is disposed at one end of the rod portion.

13. A mortise lock as recited in claim 9, wherein the spring clip has a surface accessible from outside of the lock housing which surface, when pressed, moves the spring clip relative to the head portion and the rod portion against the force of the biasing means to a releasing position where the blocking surface is out of the opening in the head portion of the latch bolt for freeing the head portion and the rod portion of the latch bolt for relative axial movement.

14. A mortise lock as recited in claim 13, wherein the surface of the spring clip is accessible through the opening the principal side wall of the housing.

15. A mortise lock as recited in claim 9, wherein the spring clip comprises a substantially flat plate having an opening and the blocking surface comprises an edge of the plate defining the opening, and wherein the head portion of the latch bolt has a slot transverse to the axis of the opening in the head portion for receiving the plate so that the openings in the plate and head portion are only partially aligned when the biasing means biases the plate into the blocking position.

16. A mortise lock as recited in claim 15, wherein the plate includes a flange extending from the plate, the flange adjacent a surface of the head portion of the latch bolt when the plate is in the slot, and the biasing means comprises a spring disposed between the flange and the surface of the head portion of the latch bolt.

17. A mortise lock latch as recited in claim 15, wherein the biasing means comprises a resilient tab extending from the periphery of the plate and engaging a surface of the head portion of the latch bolt when the plate is in the slot.

* * * * *